US006851288B2

(12) United States Patent
Howes

(10) Patent No.: US 6,851,288 B2
(45) Date of Patent: Feb. 8, 2005

(54) LOCKING MECHANISM FOR CONTAINER

(75) Inventor: Donald Howes, Victoria (CA)

(73) Assignee: Wasteline Rentals Ltd., Victoria (CA)

( * ) Notice: Subject to any disclaimer, the term of this patent is extended or adjusted under 35 U.S.C. 154(b) by 35 days.

(21) Appl. No.: 10/449,985

(22) Filed: May 30, 2003

(65) Prior Publication Data

US 2004/0099023 A1 May 27, 2004

(51) Int. Cl.[7] ..... B65D 55/14

(52) U.S. Cl. ..... 70/159; 70/58; 70/164; 220/315

(58) Field of Search ..... 70/14, 18, 19, 70/57, 58, 63, 159–169; 248/551–553; 220/908, 315

(56) References Cited

U.S. PATENT DOCUMENTS

| | | | | | |
|---|---|---|---|---|---|
| 4,182,530 | A | * | 1/1980 | Hodge | 294/68.26 |
| 4,290,281 | A | | 9/1981 | Knaack et al. | 70/54 |
| 4,585,138 | A | | 4/1986 | Jonkers | 220/67 |
| 4,609,125 | A | | 9/1986 | Willingham | 220/324 |
| 4,625,891 | A | | 12/1986 | Lilly | 220/327 |
| 4,873,848 | A | * | 10/1989 | Honeyman, III | 70/14 |
| 4,955,501 | A | * | 9/1990 | Hodge | 220/315 |
| 5,042,856 | A | * | 8/1991 | Goodman | 292/259 R |
| 5,052,199 | A | * | 10/1991 | Derman | 70/58 |
| 5,076,078 | A | | 12/1991 | Weger, Jr. | 70/54 |
| 5,085,340 | A | | 2/1992 | Doxey et al. | 220/398 |
| 5,094,358 | A | * | 3/1992 | Serio, Sr. | 220/315 |
| 5,103,994 | A | | 4/1992 | Doxey et al. | 220/324 |
| 5,118,000 | A | * | 6/1992 | Howell et al. | 220/315 |
| 5,213,382 | A | * | 5/1993 | Dawdy et al. | 292/228 |
| 5,224,743 | A | * | 7/1993 | Dawdy et al. | 292/228 |
| 5,235,830 | A | | 8/1993 | Benge | 220/56 |
| 5,415,314 | A | * | 5/1995 | McCollum | 220/315 |
| 5,419,598 | A | * | 5/1995 | Kreitzer | 292/230 |
| 5,474,341 | A | * | 12/1995 | Putman et al. | 292/230 |
| 5,595,073 | A | * | 1/1997 | Sullivan | 70/18 |
| 5,683,126 | A | * | 11/1997 | De Vivo et al. | 292/230 |
| 5,740,584 | A | | 4/1998 | Hodge et al. | 16/30 |
| 6,276,562 | B1 | | 8/2001 | Hodge et al. | 220/831 |
| 6,279,822 | B1 | * | 8/2001 | Bertram | 40/606.05 |
| 6,298,695 | B1 | * | 10/2001 | Vezina et al. | 70/58 |
| 6,427,499 | B1 | * | 8/2002 | Derman | 70/58 |
| 6,733,053 | B2 | * | 5/2004 | Hodge et al. | 292/336.3 |
| 6,772,613 | B2 | * | 8/2004 | Webb et al. | 70/159 |

* cited by examiner

*Primary Examiner*—Suzanne Dino Barrett
(74) *Attorney, Agent, or Firm*—Troutman Sanders LLP; Ryan A. Schneider

(57) ABSTRACT

A lockable container comprising an open-faced receptacle with a locking mechanism aperture, at least one lid covering at least a portion of the open face of the receptacle, and a locking mechanism for engaging with a padlock and securing the lid over the receptacle open face. The locking mechanism has a receptacle engagement portion that is moveable into a receptacle engagement position, and when in such position, a lid engagement portion attached to the receptacle engagement portion is moved over and into close proximity to the lid, and a lock engagement portion attached to the lid engagement portion is moveable into the receptacle and through the locking mechanism aperture, and out of the receptacle, where it is engageable with a padlock.

13 Claims, 4 Drawing Sheets

LOCKING MECHANISM FOR CONTAINER

FIELD OF THE INVENTION

This invention relates generally to locking mechanisms and lockable containers having such mechanisms.

BACKGROUND OF THE INVENTION

Externally-stored waste containers such as front-load and roll-off waste containers are prone to being raided by trash pickers or "dumpster divers" seeking to find valuable items among the refuse. It is desirable to discourage this activity, as it tends to create a mess around the containers, may damage the containers, and compromises the security and confidentiality of the materials being discarded. Some jurisdictions have proposed or enacted ordinances to make such activity illegal.

Many waste containers are locked to discourage dumpster diving. Typically, a metal chain is wrapped around the container and its lid and secured in place with a padlock. However, handling the chain tends to be cumbersome and the padlock and chain are exposed and thus vulnerable to tampering. There have been proposals to locate a padlock within a container such that the padlock is not exposed to tampering. For example, U.S. Pat. No. 4,290,281 (Knaack et al.) discloses a lock system for a container, such as a tool box or a storage cabinet, which is locked by a padlock. A structure within the container mounts the padlock within the container with only a key insertion end of the padlock body exposed for access thereto. However, the specific structure as disclosed is relatively complex, making construction of containers having such structure relatively expensive. Furthermore, such structure is integrated into the container in such a way that makes it difficult to retrofit to existing containers.

U.S. Pat. No. 5,076,078 (Weger Jr.) discloses a padlock protecting system for use with a container having a movable closure. A shelf supports the padlock within the container such that only the key insertion end of the padlock is exposed for external access and a bracket having one or more depending legs is carried by the supporting shelf and captures the shackle of the padlock. A tang is associated with the movable closure and is positionable within the shackle to capture the padlock thereby maintaining the closure in a closed position. Like the '281 patent, the padlock protecting system disclosed in Weger is relatively complex, and is integrated into the container in such a way that makes it difficult to retrofit to existing containers.

It is therefore desirable to provide a locking mechanism for a container, that is relatively simple, effective to keep the container lid in a closed position, and is resistant to tampering. It is further desirable to provide a locking mechanism that can be retrofitted to an existing container.

SUMMARY OF THE INVENTION

According to one aspect of the invention, there is provided a lockable container comprising an open-faced receptacle, at least one lid covering at least a portion of the open face of the receptacle, and a locking mechanism for engaging with a padlock and securing the lid over the receptacle open face. The receptacle comprises a base, a top with a main receptacle opening, and a side wall extending around and between the base and top and having a locking mechanism aperture. The lid is mountable to the receptacle and is configured to cover at least a portion of the receptacle opening. The locking mechanism comprises a receptacle engagement portion with a proximal end attached to the receptacle and a distal end extending above the mounted lid when the receptacle engagement portion is moved into a lid engagement position. The locking mechanism also has a lid engagement portion attached to the receptacle engagement portion such that the lid engagement portion extends sufficiently over the lid to impede it from opening when the receptacle engagement portion is in the lid engagement position. And finally, the locking mechanism has a lock engagement portion attached to the lid engagement portion and is extendable through the receptacle opening into the receptacle, then through the locking mechanism aperture and out of the receptacle, and is securable in place with the padlock, when the receptacle engagement portion is in the lid engagement position.

The receptacle engagement portion can be a pivot arm having a proximal end pivotably attached to the receptacle side wall and a distal end extending above the mounted lid when the pivot arm is pivoted into the lid engagement position. The lid engagement portion can be an elongated member attached to the pivot arm such that the member extends sufficiently over the lid to impede it from opening when the pivot arm is in its lid engagement position. The lock engagement portion can be a lock arm having a proximal end pivotably attached to the elongated member and a distal end with an aperture for receiving a shackle of the padlock. When the pivot arm is in the lid engagement position, the lock arm is pivotable into a lid securing position with the distal end extending through the receptacle opening into the receptacle, then through the locking mechanism aperture out of the receptacle, and securable in place with the padlock.

The lockable container can comprise a pair of lids mountable side-by-side over the receptacle opening such that sufficient space is provided therebetween to enable the lock arm to pivot into the receptacle; the lids are mounted on the receptacle such that the elongated member extends over both lids.

The receptacle engagement portion may comprise a pair of pivot arms both pivotably attached at their proximal ends to the side walls about the same pivot axis; in such case, the distal ends of the pivot arms are attached to the respective ends of the elongated member.

The side wall can include a recess for receiving the padlock, and in such case, the lock mechanism aperture is located in a back wall of the recess. The recess dimensions can be selected to snugly receive the padlock in the recess thereby impeding access of padlock tampering devices to the padlock.

According to another aspect of the invention, there is provided the locking mechanism as described above, that is attachable to a container having an open-faced receptacle and a lid that covers at least a portion of the open face. The container is provided with a locking mechanism aperture on its side wall, to receive a lock engagement portion of the locking mechanism.

According to yet another aspect of the invention, there is provided a locking mechanism for a container having a receptacle with a base, a top with a main receptacle opening, a side wall extending around and between the base and top, and a lid mountable to the receptacle and configured to cover at least a portion of the main receptacle opening. The locking mechanism comprises:

- a locking plate having an aperture configured to receive a padlock, and mountable to the receptacle side wall;
- a pivot arm having a proximal end pivotably attachable to the receptacle side wall, a distal end, and an aperture configured to receive the padlock, the pivot arm being pivotable into a lid engagement position wherein the distal end extends above the mounted lid and the aperture aligns with the locking plate aperture; and an elongated member attached to the pivot arm such that the member extends sufficiently over the lid to impede its opening when the pivot arm is in its lid engagement position.

BRIEF DESCRIPTION OF DRAWINGS

FIG. 4(*b*) is a schematic side elevation view of a portion of a second embodiment of the waste container, having a slotted plate for receiving a padlock.

DETAILED DESCRIPTION OF EMBODIMENTS OF THE INVENTION

Figure 1:
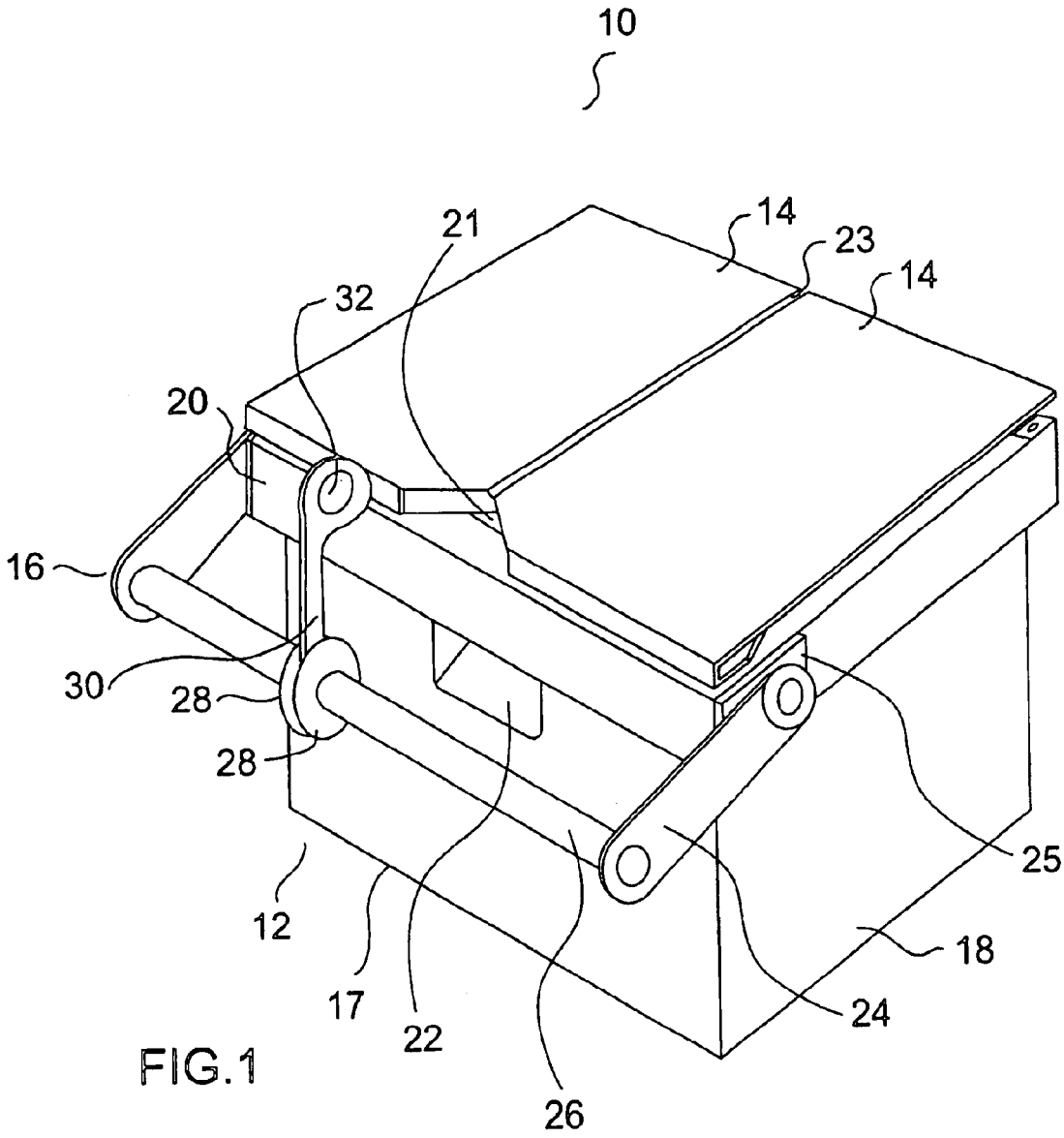
FIG. 1 is a schematic perspective view of an embodiment of a lockable waste container, having a locking mechanism in an unengaged position.
Figure 2:
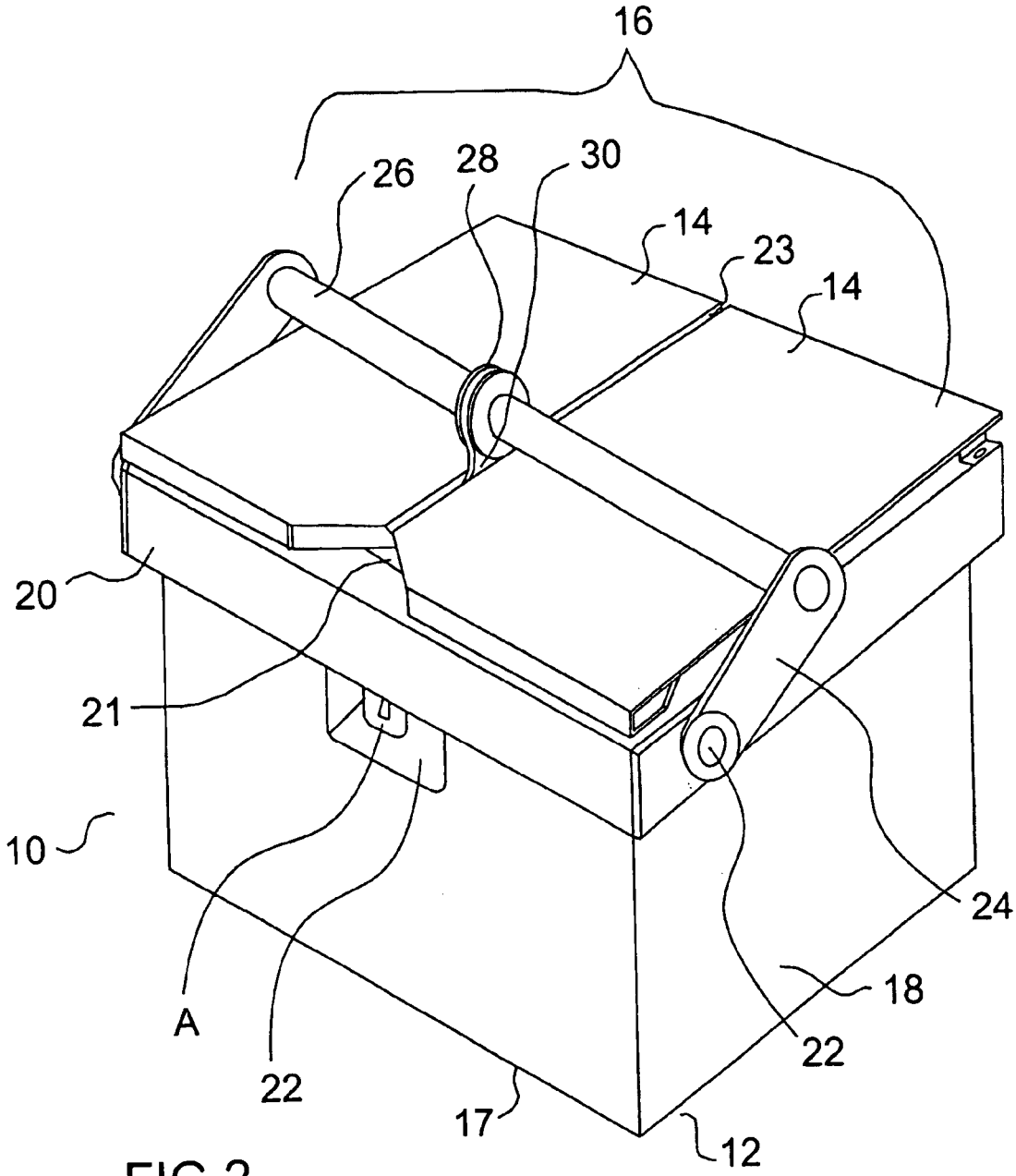
FIG. 2 is a schematic perspective view of the waste container wherein its locking mechanism is in an engaged position.

Directional terms such as "top", "bottom", and "upwards" are used in the following description for the purpose of providing relative reference only, and are not intended to suggest any limitations on how any apparatus is to be positioned during use, or to be mounted in an assembly.

Referring to FIGS. 1–4 and according to a first embodiment of the invention, a lockable waste container 10 comprising a receptacle 12 and a pair of lids 14 is also provided with a locking mechanism 16 that when locked, secures the lids 14 in place over the receptacle 12 to prevent unauthorized access into the container 10. Alternatively, the locking mechanism 16 may be retrofitted onto existing conventional waste containers, such as front load or roll-off waste containers.

The container receptacle 12 includes a rectangular base 17, four side walls 18 extending around and upwards from the base 17 to form an open-faced box. A lip 20 extends around the periphery of the upper edge of the side walls 18. The open face of the receptacle 12 serves as a main receptacle opening 21 for receiving waste. A receiving cup 22 is recessed into the front sidewall 18, and has a depth sufficient to receive a conventional padlock A (shown in FIG. 2). It is within the scope of the invention for the receptacle to have other shapes, e.g. cylindrical.

The pair of lids 14 are pivotably mounted to the back lip 20 of the receptacle 12 by respective hinges (not shown) such that the lids 14 are pivotable between an opened position and a closed position. The lids 14 may be made from plastic or metal. The lids 14 are mounted side by side and when in the closed position, cover substantially all of the receptacle opening, leaving a narrow slot 23 therebetween. Preferably, the slot width is selected to be narrow enough to prevent a hand from entering inside the receptacle when the lids 14 are closed.

The locking mechanism 16 comprises a pair of pivot arms 24 each having a proximal end pivotably mounted to a mounting plate 25. Each mounting plate 25 is welded to each side lip 20 of the receptacle 12 along the same pivot axis. The pivot arms 24 may be moved between an lid unengaged position wherein the distal portion of the pivot arms 24 extend in front of the front side wall (shown in FIG. 1) and a lid engaged position wherein the distal portion of the pivot arms 24 extend over the top of the receptacle (shown in FIG. 2). The locking mechanism 16 also includes a lock bar 26 which is an elongated member that is attached at its respective ends to the distal ends of the pivot arms 24. When the pivot arms 24 are moved into their lid engaged position, the lock bar 26 extends transversely across both lids 14. The lock bar 26 can rest on the top surface of the lids 14, or, be placed in sufficient proximity over the lids 14 that the lids 14 cannot be opened enough for a "dumpster diver" to reach inside the receptacle 12.

The locking mechanism 16 also includes a lock arm 30 pivotably connected at its proximal end to the lock bar 24 such chat the lock arm is pivotable about an axis coincidental with the longitudinal axis of the lock bar 26. The lock arm 30 has an aperture 32 at its distal end that is dimensioned to receive a shackle of a conventional padlock A. The lock arm 30 is preferably located in position on the lock bar 26 using a pair of shoulders 28 welded onto the lock bar 26 on either side of the lock arm 30.

Figure 4A:
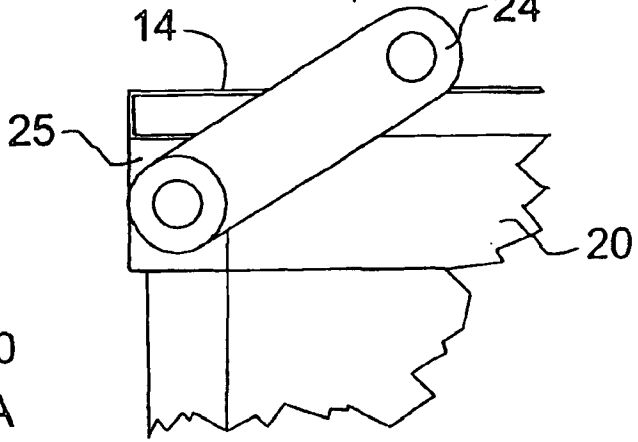
FIG. 4(*a*) is a schematic side elevation view of a portion of the waste container with its locking mechanism in the engaged position.
Figure 4B:
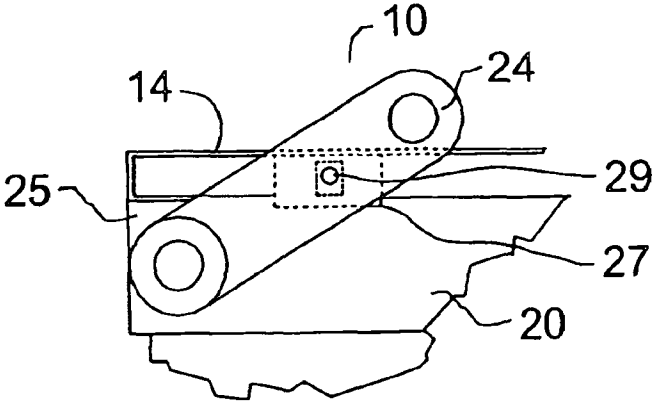
Figure 3:
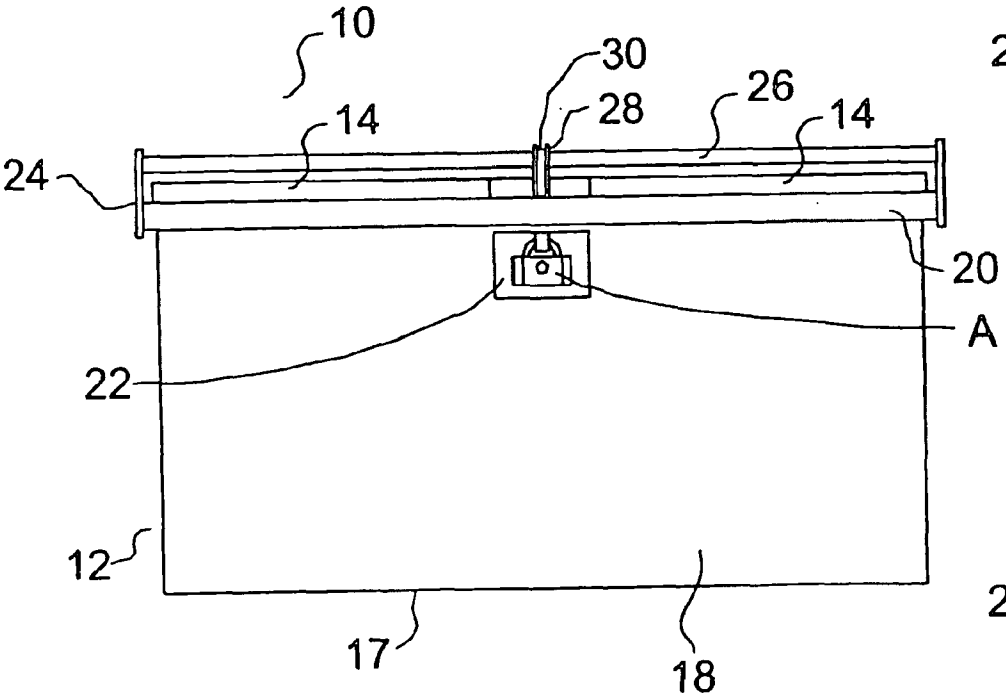
FIG. 3 is a schematic front elevation view of the waste container with its locking mechanism in the engaged position.

Referring particularly to FIG. 4(*b*) and according to a second embodiment of the invention, a second locking mechanism is provided that includes a slotted locking plate 27 welded to the side lip 20 of the receptacle 12 behind the mounting plate 25. A hole 29 is located through one of the pivot arms 24 such that when the pivot arms 24 are in their lid engaged position, the hole 29 is aligned with the slot in the slotted locking plate 27. A padlock (not shown) can then be used to secure the pivot arm 24 in its lid engaged position, by threading its shackle through the slotted locking plate 27 and hole 29.

The second locking mechanism may be used instead of or in conjunction with the first locking mechanism 16 in the container 10.

Figure 5:
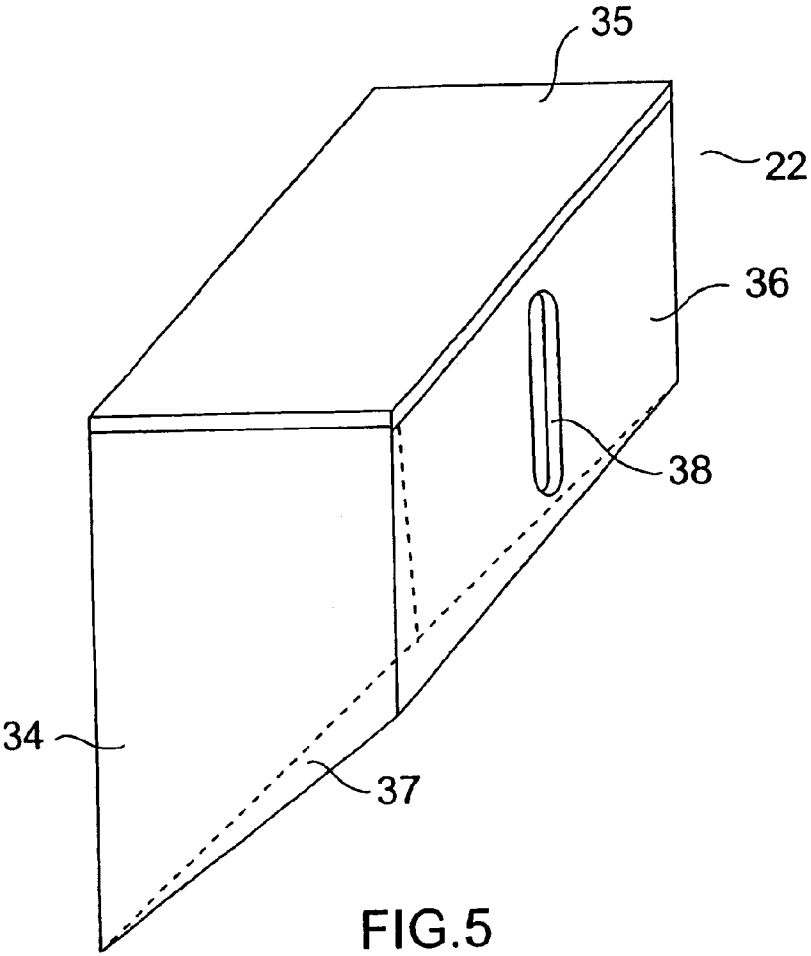
FIG. 5 is a schematic perspective view of a receiving cup of the waste container.

Referring back to the first embodiment, and to FIG. 5, the receiving cup 22 is formed by welding together a pair of side plates 34, top plate 35, back plate 36, and bottom plate 37, then welding the cup 22 to a suitably shaped and positioned opening in the front wall 18 such that a recess is provided in the front wall 18. (When retrofitting the locking mechanism 16 to a conventional container, the opening will have to be cut in the front wall 18) The cup back wall 36 includes a receiving cup aperture 38 dimensioned to receive the distal end of the lock arm 30 therethrough. The top and bottom plates 35, 37 taper downwardly and upwardly respectively towards the back plate 36. The tapered top plate 35 serves to reduce the tendency for refuse to lodge against the receiving cup 22 when loading the receptacle 12, and similarly, the tapered bottom plate 37 serves to reduce the tendency for refuse to lodge against the receiving cup 22 when the receptacle 12 is emptied (and turned upside-down).

Figure 6:
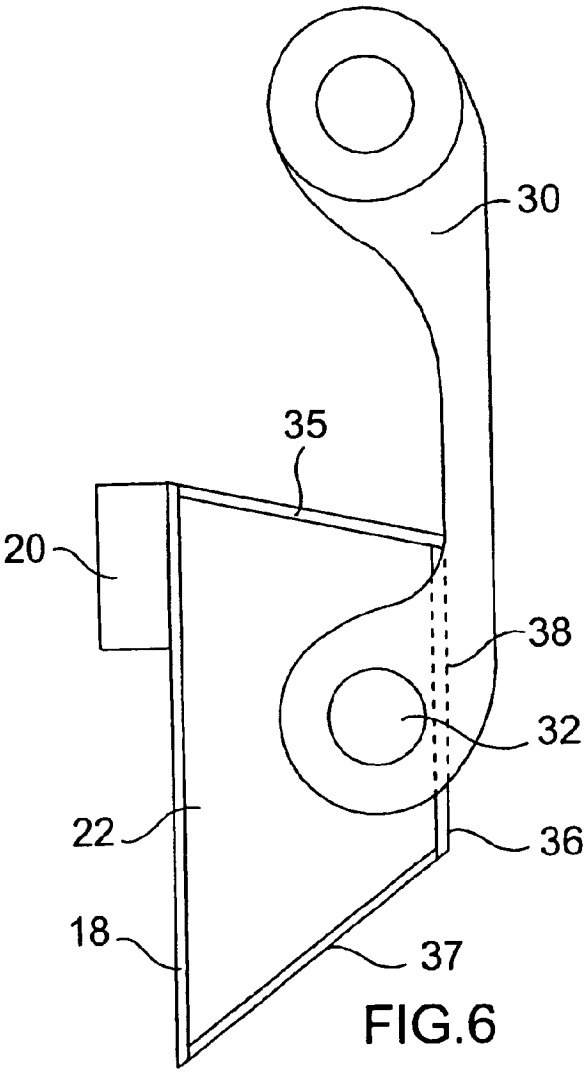
FIG. 6 is a sectioned schematic side view of the locking mechanism engaged with the receiver cup.

Referring to FIG. 6, the distal end of the lock arm 30 is shaped and sized to pass through the receiving cup aperture 38. When the pivot arms 24 are moved into the lid engaged position, the lock arm 30 can be pivoted into a "locking position" wherein its distal end enters into the receptacle 12 through the slot 23 in between the lids 14, through the receiving cup aperture 38, and into the receiving cup 22. Enough of the distal end of the lock arm 30 protrudes through the receiving cup aperture 38 that the lock arm aperture 32 is located entirely in the receiving cup 22. The padlock A (not shown in FIG. 6) can then be fastened to the lock arm 30 by threading its shackle through the lock arm aperture 32. Provided that the body of the padlock A is wider than the locking mechanism aperture 38, the lock arm 38 is secured in this position. When secured in the locking position, the lock bar 30 prevents the lids 14 from being opened enough for a person to readily access the contents of the container 10. Furthermore, when in the locking position, the locking mechanism 16 is tamper-resistant, as most of the lock arm 30 is located inside the receptacle 12 and out of harm's way, and the padlock A is embedded within the receiving cup 22, making it difficult to reach the padlock shackle, e.g. with metal cutters. The width of the receiving cup 22 is selected to be slightly wider than the width of the padlock, thereby making it hard to use a tool to tamper with the padlock. A particularly useful type of padlock for use with the locking mechanism is a circular shield-type padlock, which minimizes the exposure of the shackle.

The locking mechanism can be made with a hardened or tempered steel to provide with increased resistance to tampering. However, it is within the scope of the invention to select alternative materials of similar properties.

While the preferred embodiment of the invention has been illustrated and described, it will be appreciated that various changes can be made therein without departing from the scope and spirit of the invention. For example, a single pivot arm may be provided in place of the pair shown in the Figures. Also, the container may be provided with a single lid instead of the pair shown in the Figures; in such case, the lid is provided with an aperture dimensioned to receive the lock arm therethrough.

What is claimed is:

1. A lockable container comprising:

(a) a receptacle comprising a base, a top with a main receptacle opening, and a side wall extending around and between the base and top and having a locking mechanism aperture, (b) a lid mountable to the receptacle and configured to cover at least a portion of the receptacle opening;

(c) a locking mechanism comprising a receptacle engagement portion having a proximal end attached to the receptacle and a distal end extending above the mounted lid when the receptacle engagement portion is moved into a lid engagement position; a lid engagement portion attached to the receptacle engagement portion such that the lid engagement portion extends sufficiently over the lid to impede the lid from opening when the receptacle engagement portion is in the lid engagement position; and a lock engagement portion attached to the lid engagement portion and extendable through the receptacle opening into the receptacle, and through the locking mechanism aperture out of the receptacle, and securable in place with a padlock, when the receptacle engagement portion is in the lid engagement position.

2. The lockable container of claim 1 wherein the receptacle engagement portion is a pivot arm having a proximal end pivotably attached to the receptacle side wall and a distal end extending above the mounted lid when the pivot arm is pivoted into the lid engagement position.

3. The lockable container of claim 2 wherein the lid engagement portion is an elongated member attached to the pivot arm such that the member extends sufficiently over the lid to impede the lid from opening when the pivot arm is in its lid engagement position.

4. The lockable container of claim 3 wherein the lock engagement portion is a lock arm having a proximal end pivotably attached to the elongated member and a distal end with an aperture for receiving the padlock, and when the pivot arm is in the lid engagement position, the lock arm is pivotable into a lid securing position with the distal end extending through the receptacle opening into the receptacle, then through the locking mechanism aperture out of the receptacle, and securable in place with the padlock.

5. The lockable container of claim 4 comprising a pair of lids mountable side-by-side over the receptacle opening such that sufficient space is provided therebetween to enable the lock arm to pivot into the receptacle, tho lids being mounted on the receptacle such that the elongated member extends over both lids.

6. The lockable container of claim 5 wherein the receptacle engagement portion comprise a pair of pivot arms both pivotably attached at their proximal ends to the side walls about the same pivot axis, the distal ends of the pivot arms being attached to the respective ends of the elongated member.

7. The lockable container of claim 6 wherein the side wall includes a recess for receiving the padlock, and the lock mechanism aperture is located in a back wall of the recess.

8. The lockable container of claim 7 wherein the recess dimensions are selected to snugly receive the padlock in the recess thereby impeding access of padlock tampering devices to the padlock.

9. A locking mechanism for a container having a receptacle with a base, a top with a main receptacle opening, and a side wall extending around and between the base and top and having a locking mechanism aperture, and a lid mountable to the receptacle and configured to cover at least a portion of the main receptacle opening, the locking mechanism comprising:

(a) a receptacle engagement portion having a proximal end attachable to the receptacle and a distal end extending above the mounted lid when the receptacle engagement portion is moved into a lid engagement position;

(b) a lid engagement portion attached to the receptacle engagement portion such that the lid engagement portion extends sufficiently over the lid to impede the lid from opening when the receptacle engagement portion is in the lid engagement position; and (c) a lock engagement portion attached to the lid engagement portion and extendable through the receptacle opening into the receptacle, then through the locking mechanism aperture out of the receptacle, and securable in place with a padlock, when the receptacle engagement portion is in the lid engagement position.

10. The locking mechanism of claim 9 wherein the receptacle engagement portion is a pivot arm having a proximal end pivotably attachable to the receptacle side wall and a distal end extended above the mounted lid when the pivot arm is pivoted into a lid engagement position.

11. The locking mechanism of claim 10 wherein the lid engagement portion is an elongated member attached to the pivot arm such that the member extends sufficiently over the lid to impede the lid from opening when the pivot arm is in its lid engagement position.

12. The locking mechanism of claim 11 wherein the lock engagement portion is a lock arm having a proximal end pivotably attached to the elongated member and a distal end with an aperture for receiving a padlock, and when the pivot arm is in the lid engagement position, the lock arm may be pivoted into a lid securing position with the distal end extending through the receptacle opening into the receptacle, then through the locking mechanism aperture out of the receptacle, and securable in place with the padlock.

13. The locking mechanism of claim 12 wherein the receptacle engagement portion comprises a pair of pivot arms both pivotably attachable at their proximal ends to the side walls about the same pivot axis, the distal ends of the pivot arms being attached to the respective ends of the elongated member.

* * * * *